United States Patent [19]

Takahashi

[11] Patent Number: 4,688,524

[45] Date of Patent: Aug. 25, 1987

[54] APPARATUS FOR COOLING CYLINDER HEAD OF AN ENGINE

[75] Inventor: Ken Takahashi, Shizuoka, Japan

[73] Assignee: Suzuki Motor Co., Ltd., Japan

[21] Appl. No.: 775,338

[22] Filed: Sep. 12, 1985

[30] Foreign Application Priority Data

Sep. 14, 1984 [JP] Japan ..... 59-193092

[51] Int. Cl.[4] ..... F01P 3/16; F01M 5/00

[52] U.S. Cl. ..... 123/41.32; 123/90.27; 123/90.38; 123/188 GC; 123/41.82 R; 123/41.42

[58] Field of Search ..... 123/41.31, 41.32, 41.82 R, 123/41.82 A, 193 H, 196 M, 196 AB, 90.37, 90.36, 90.33, 90.27, 188 GC

[56] References Cited

U.S. PATENT DOCUMENTS 2,085,810 7/1937 Ljungstrom ..... 123/41.42

4,404,936 9/1983 Tatebe et al. ..... 123/90.38

*Primary Examiner*—William A. Cuchlinski, Jr.

*Attorney, Agent, or Firm*—Diller, Ramik & Wight

[57] ABSTRACT

An apparatus for cooling the cylinder head of an engine including a plurality of recesses formed in the cylinder head at the position located above the combustion chambers to accumulate oil therein and covers adapted to cover the recesses. Oil accumulated in the recesses serves to cool the cylinder head and the covers inhibit oil from being scattered from each of the recesses.

6 Claims, 15 Drawing Figures

APPARATUS FOR COOLING CYLINDER HEAD OF AN ENGINE

BACKGROUND OF THE INVENTION

1. Field of the Invention

The present invention relates to an apparatus for cooling the cylinder head of an engine, particularly, an air cooling type internal combustion engine.

2. Description of the Prior Art

As is well known, various types of cooling methods are employed for engine, particularly, internal combustion engine in order to protect it from adversely affected state due to heat generated in combustion chambers and maintain it under the properly determined temperature condition.

The conventional cooling methods are generally classified into cooling method with the use of air flowing and cooling method with the use of water flowing.

Specifically, the air cooling method is intended to cool engine by utilizing flowing of air which passes by the surface of fins standing upright from both the cylinder block and cylinder heads of the engine.

On the other hands, the water cooling method is intended to cool engine by utilizing flowing of water through water jackets which are formed in both the cylinder block and the cylinder head.

When the air cooling method is employed for the purpose of cooling engine, there is only a necessity for forming a number of heat radiating fins on both the cylinder block and the cylinder head of the engine and this leads to an advantageous feature that the whole engine can be designed and constructed in a very simple structure. However, it has drawbacks that it is difficult to uniformly cool down the whole engine, temperature control is achieved only with much difficulties and both the cylinder block and the cylinder head are liable to be deformed thermally.

On the other hands, when the water cooling method is employed for the same purpose, every part of engine can be cooled more uniformly than the air cooling method. However, it has drawbacks that the engine is constituted by a large number of parts and components because of a necessity for arranging radiator, fan and others and moreover it is produced by way of many complicated steps (inclusive a step for producing a core) because of a necessity for forming water jackets in both the cylinder block and the water head, resulting in increased production cost.

SUMMARY OF THE INVENTION

Hence, the present invention has been made with the foregoing background in mind and its object resides in providing an apparatus for cooling the cylinder head of an engine which is simple in structure and assures that the area located in the vicinity of the combustion chambers in the cylinder head is cooled uniformly.

Other object of the present invention is to provide an apparatus for cooling the cylinder head of an engine which assures that the cylinder head is produced at a reduced cost without any necessity for a complicated step for preparing water jackets.

Another object of the present invention is to provide an apparatus for cooling the cylinder head of an engine which assures that scattering of oil fed to the interior of the cylinder head is prevented and moreover an occurrence of mechanical loss attributable to adhesion of an excessive amount of oil and an increased rate of consumption of oil are minimized.

Further another object of the present invention is to provide an apparatus for cooling the cylinder head of an engine which assures that valve spring seats are easy to be assembled in the cylinder head, resulting in reduced manhours required for assembling the cylinder head.

Still further another object of the present invention is to provide an apparatus for cooling the cylinder head of an engine which assures that undesirable turning movement of the valve spring seats in inhibited and moreover durability of valve seats and valve spring seats is improved.

To accomplish the above objects there is proposed according to the present invention an apparatus for cooling the cylinder head of an engine which is characterized in that the apparatus comprises a plurality of recesses for accumulating oil therein, the recesses being formed in the cylinder head at the position located above the combustion chambers, and covers adapted to cover the recesses whereby the cylinder head is cooled down by means of oil which has been accumulated in the recesses.

In a preferred embodiment of the invention the covers are designed in the plate-shaped configuration and they have an U-shaped cross-sectional configuration.

Other objects, features and advantages of the invention will become readily apparent from reading of the following description which has been prepared in conjunction of the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to the accompanying drawings which illustrate an apparatus according to preferred embodiments thereof.

Figure 1:
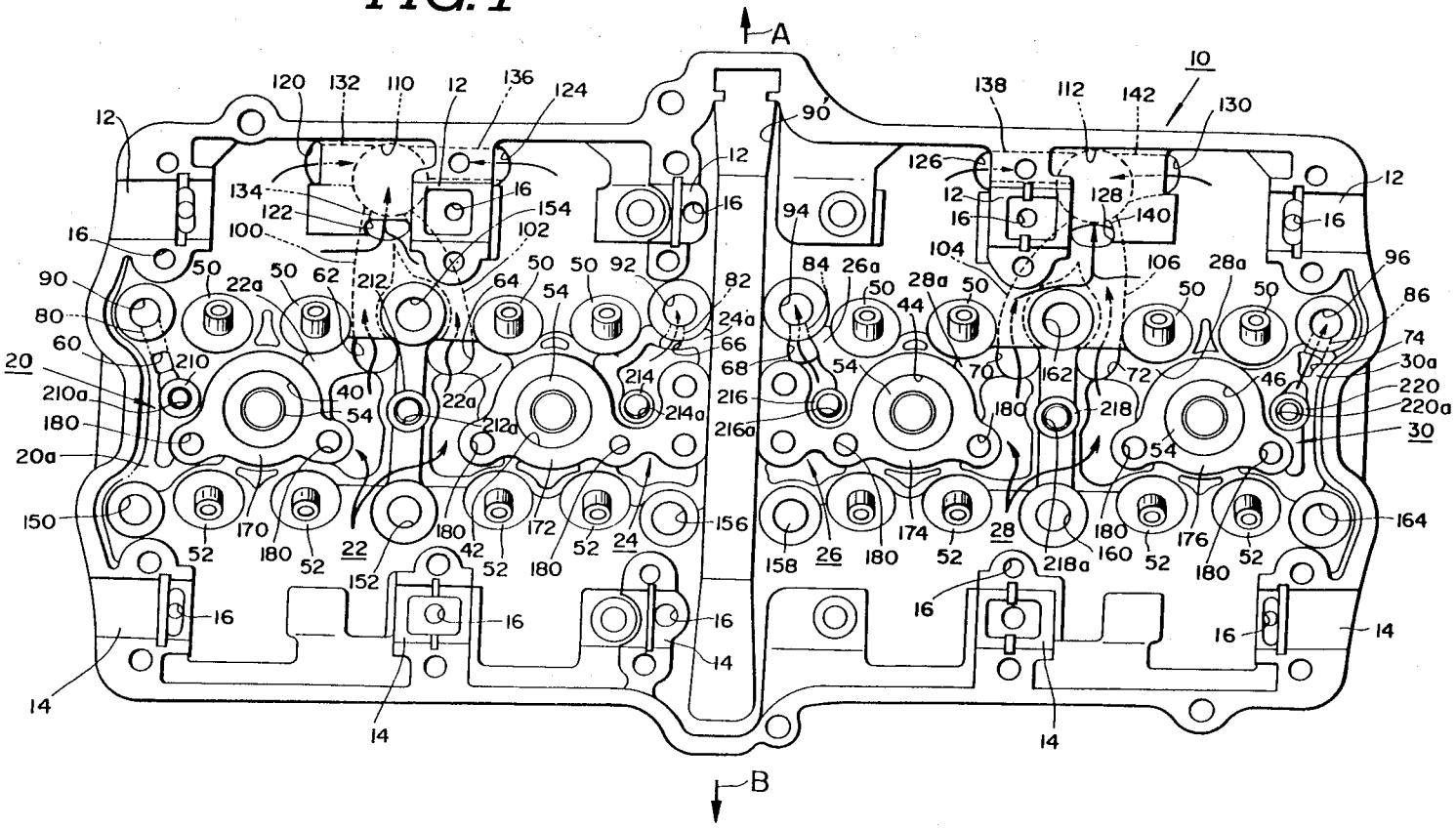
FIG. 1 is a plan view of the cylinder head with the apparatus of the invention incorporated therein, as seen from the above.
Figure 2:
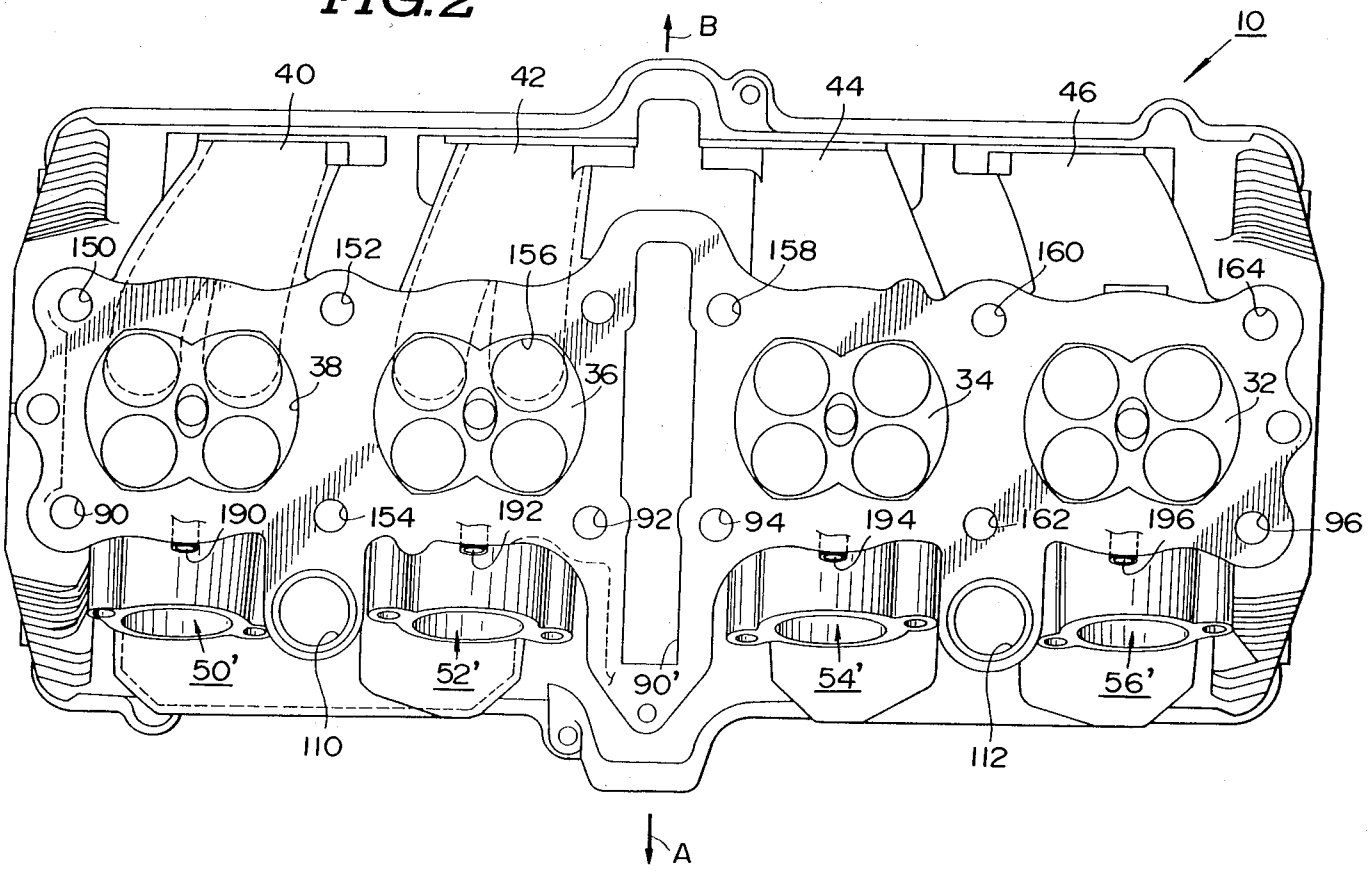
FIG. 2 is a plan view of the cylinder head in FIG. 1, as seen from the below.

FIG. 1 and 2 are a plan view of a cylinder head 10 as seen from the above and the below respectively, in which oil passages according to the present invention are employed for the cylinder head 10, particularly for cylinder head used for a double overhead camshaft type engine preferably mounted on motorcycle.

As shown in FIG. 1, the cylinder head 10 is provided with bearing portions 12 and 14 for cam shafts (not shown) adapted to drive rocker arms. Specifically, the bearing portions 12 are located on the exhaust side (as identified by an arrow mark A), while the bearing portions 14 are located on the inlet port side (as identified by an arrow mark B). Further, the cylinder head 10 is provided with another bearing portions for rocker shafts (not shown) adapted to turnably support rocker arms on both the exhaust and inlet sides at the position located below the bearing portions 12 and 14.

As is apparent from FIG. 1, a plurality of lubricating oil spouting holes 16 through which pressurized lubricating oil (hereinafter referred to simply as oil) is pumped up via oil galleries (not shown) formed in the cylinder head 10 are disposed at the position located in the vicinity of the bearing portions 12 and 14.

Figure 3:
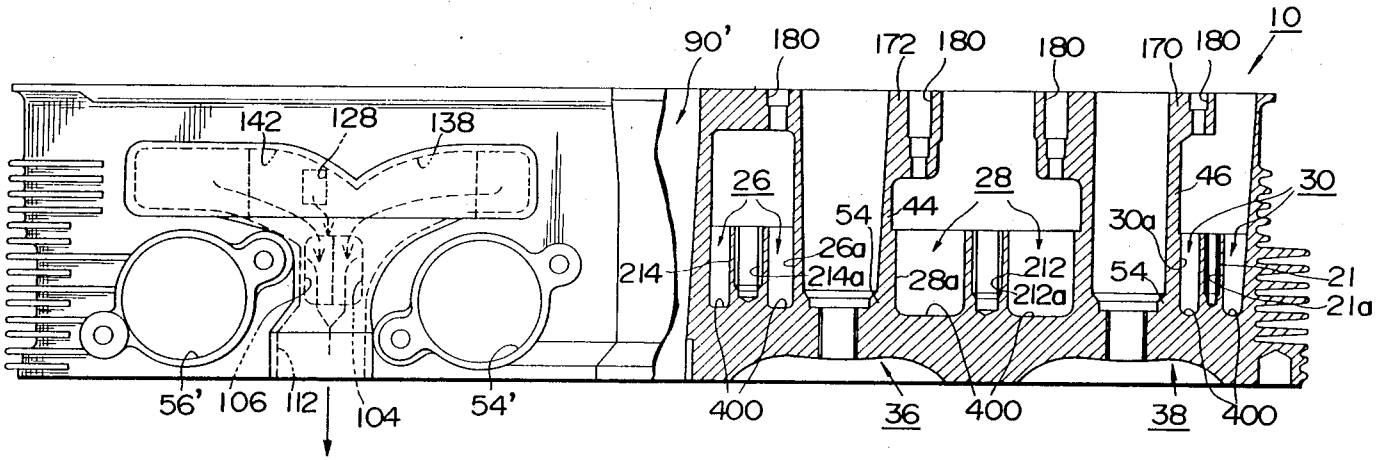
FIG. 3 is partially sectioned front view of the cylinder head in FIG. 1.

Referring to FIGS. 1 again, a plurality of recesses 20, 22, 24, 26, 28 and 30 are formed in the area extending in the longitudinal direction on the middle part of the inner surface of the cylinder head 10. Specifically, the recesses 20, 22, 24, 26, 28 and 30 are disposed at the position located approximately above combustion chambers 32, 34, 36 and 38 as illustrated in FIG. 2. Further, referring to FIG. 3 which is a partially sectioned front view of the cylinder head 10, the recesses 20, 22, 24, 26, 28 and 30 are formed in the area including the space as defined by the bore diameter of the combustion chambers 32, 34, 36 and 38 (but excluding the area occupied by cylindrical bosses 40, 42, 44 and 46 for mounting ignition plugs, the cylindrical bosses 40, 42, 44 and 46 being located above the central part of the combustion chambers 32, 34, 36 and 38). Thus, as shown in FIG. 1, the peripheral walls 20*a*, 22*a*, 24*a*, 26*a*, 28*a* and 30*a* of the recesses 20, 22, 24, 26, 28 and 30 are located adjacent to the peripheral walls of valve seats 50 for supporting exhaust valves and valve seats 52 for supporting inlet valves and moreover, as shown in FIG. 3, they are located adjacent to the peripheral walls of the ignition plug seats 54 provided for the combustion chambers 32, 34, 36 and 38. As oil is supplied into the recesses 20, 22, 24, 26, 28 and 30 formed in the above-described manner via an injection from oil feeding passages which will be described later, it is increasingly accumulated in each of the recesses 20, 22, 24, 26, 28 and 30 and a thermal boundary layer between each of the recesses and thus accumulated oil is then disturbed or broken whereby heat transmitted from the combustion chambers 32, 34, 36 and 38 (see FIG. 2), the valve seats 50 and 52 and the ignition plug seats 54 is absorbed by thus accumulated oil, resulting in the major part of the cylinder head 10 being cooled sufficiently. On the other hands, as shown in FIG. 1, the peripheral walls 20*a*, 22*a*, 24*a*, 26*a*, 28*a* and 30*a* of the recesses 20, 22, 24, 26, 28 and 30 are formed with a plurality of oil discharging holes 60, 62, 64, 66, 68, 70, 72 and 74 through which an excessive amount of oil accumulated in the recesses 20, 22, 24, 26, 28 and 30 is discharged continuously. Among them the oil discharging holes 60, 66, 68 and 74 in the recesses 20, 24, 26 and 30 formed at both the lefthand and righthand end parts of the cylinder head 10 as well as at the position located opposite to one another relative to a cam chain chamber 90′ are communicated with stud bolt insert holes 90, 92, 94 and 96 via oil discharging passages 80, 82, 84 and 86. Accordingly, oil in the recesses 20, 24, 26 and 30 is caused to flow into the insert holes 90, 92, 94 and 96 through the discharging holes 60, 66, 68 and 74 and the discharging passages 80, 82, 84 and 86 and thereafter it is returned to an oil pan on the engine via the insert holes 90, 92, 94 and 96. On the other hands, the discharging holes 62, 64, 70 and 72 in the recesses 22 and 28 are communicated with main discharging passages 110 and 112 formed on the exhaust ports side via discharging passages 100, 102, 104 and 106. As illustrated in FIG. 3, the main discharging passages 110 and 112 are formed at the position located between the adjacent exhaust ports on the outer surface of the cylinder head 10. The discharging passages 100, 102, 104 and 106 are formed at the position located adjacent to the wall surface of the exhaust ports in the cylinder head 10. Owing to the arrangement made in that way heat developed in the exhaust ports is absorbed by oil in the recesses 22 and 28 while it is discharged into the main discharging passages 110 and 112 via the discharging passages 100, 102, 104 and 106 whereby the exhaust ports are cooled satisfactorily.

Figure 4:
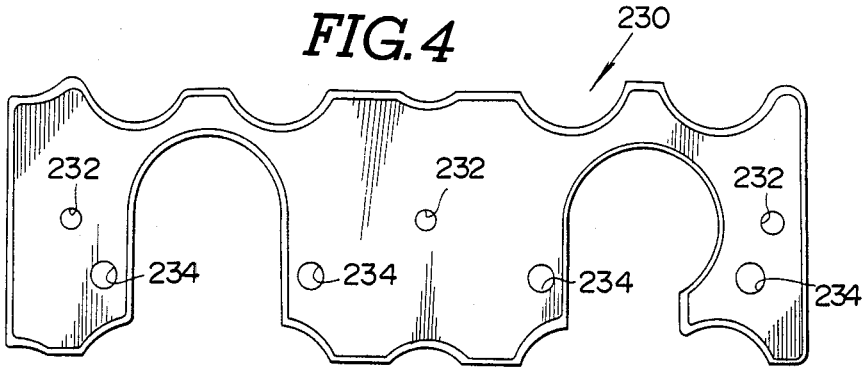
FIG. 4 is an enlarged plan view of a cover to be fitted to the cylinder head.
Figure 5:
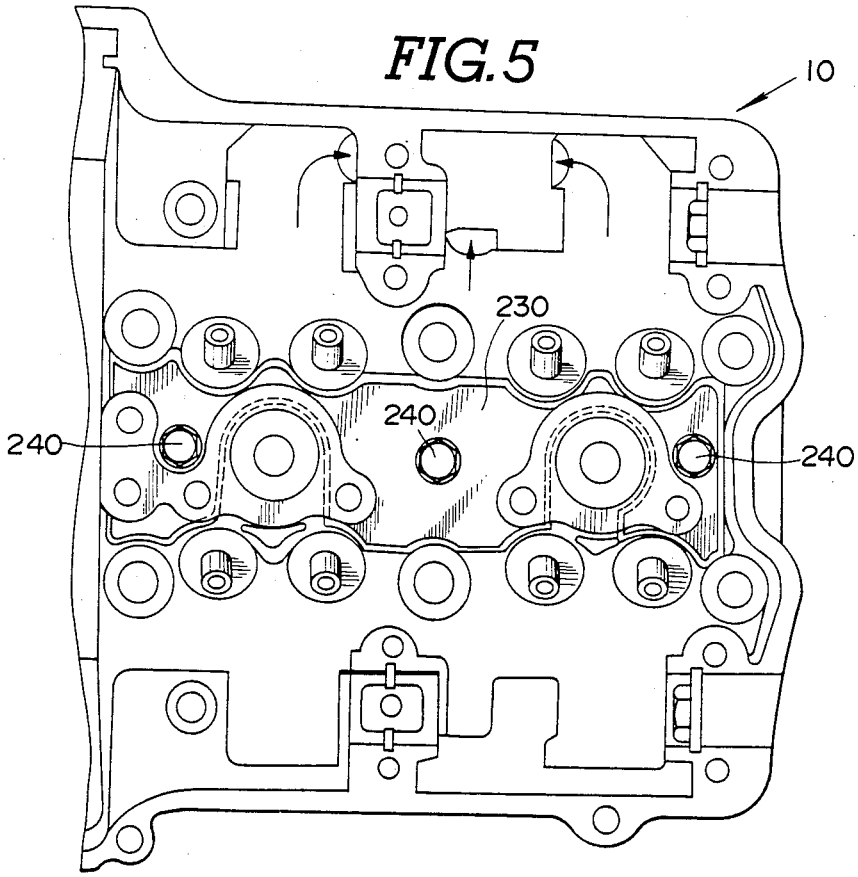
FIG. 5 is a plan view of the right half of the cylinder head with the cover fitted thereto, as seen from the above.
Figure 6:
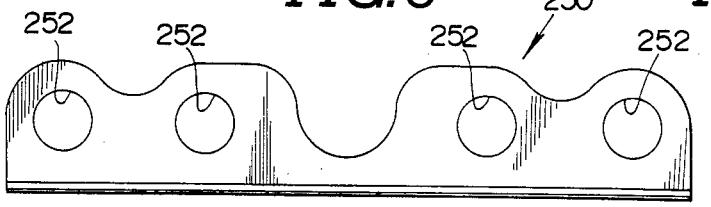
FIG. 6 is an enlarged plan view of a valve spring seat.
Figure 7:
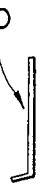
FIG. 7 is a side view of the valve spring seat in FIG. 6.
Figure 8:
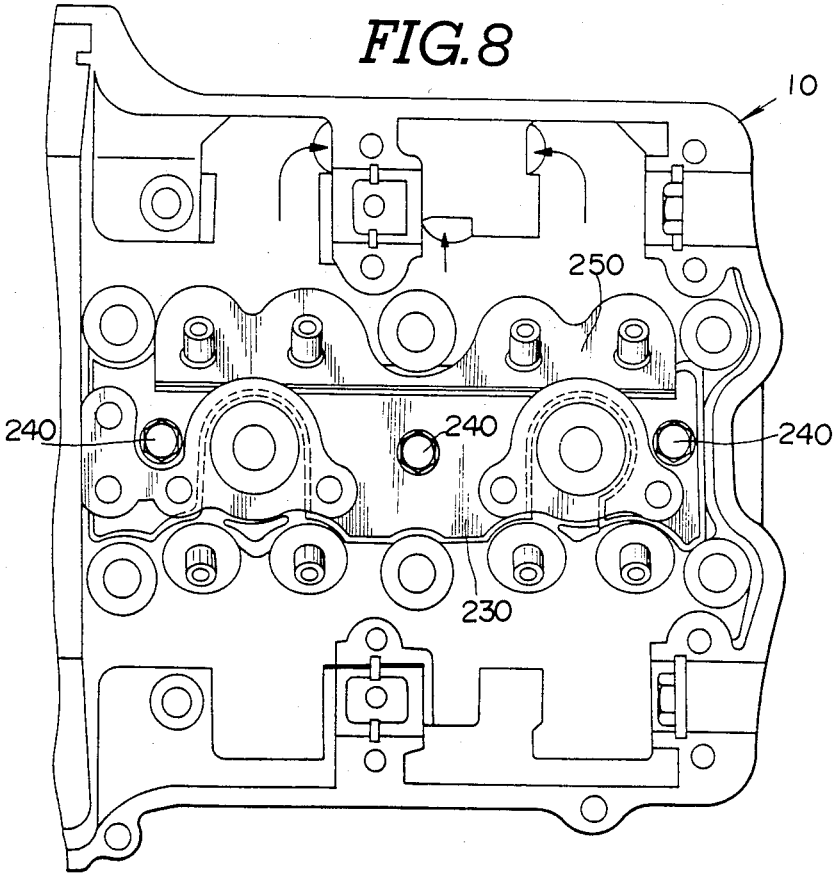
FIG. 8 is a plan view of the right half of the cylinder head with the valve spring seat attached thereto, as seen from the above.

In addition to the discharging passages 100, 102, 104 and 106 which are in communication with the recesses 22 and 28 the main discharging passages 110 and 112 are communicated with discharging passages 132, 134, 136, 138, 140 and 142 which include openings 120, 122, 124, 126, 128 and 130 on the inner surface of the cylinder head 10, causing oil flowing in the area located above the exhaust ports in the cylinder head 10 to be discharged into the main discharging passages 110 and 112 via the discharging passages 132, 134, 136, 138 and 140, as shown in FIGS. 1 and 3. Incidentally, in FIG. 1 reference numerals 150, 152, 154, 156, 158, 160, 162 and 164 designate a stud bolt insert hole respectively, through which a stud bolt (not shown) is inserted and reference numerals 170, 172, 174 and 176 do a flange portion on the top of the ignition plug mounting bosses 40, 42, 44 and 46. Each of the flange portions 170, 172, 174 and 176 is formed with a hole 180 which constitutes a part of oil feeding passage to be described later through which oil is fed into the recesses 20, 22, 24, 26, 28 and 30. Further, in FIG. 2 reference numerals 190, 192, 194 and 196 designates a hole respectively, which is formed at the position located below the exhaust ports 50′, 52′, 54′ and 65′. The holes 190, 192, 194 and 196 are communicated with the interior of the ignition plug mounting bosses 40, 42, 44 and 46 as shown in FIG. 1. Referring to FIGS. 3 and 1 again, reference numerals 210, 212, 214, 216, 218 and 220 designate a boss standing upright in the recesses 20, 22, 24, 26, 28 and 30 respectively. The bosses 210, 212, 214, 216, 218 and 220 are formed with female threads 210*a*, 212*a*, 214*a*, 216*a*, 218*a* and 220*a* (see FIG. 1). The female threads 210*a*, 212*a*, 214*a*, 216*a*, 218*a* and 220*a* are adapted to function as female portion for fastening a plate-shaped cover 230 as shown in FIG. 4 in an enlarged scale. The configuration of the cover 230 is designed to independently cover the lefthand area as defined by the group of recesses 20, 22 and 24 and the righthand area as defined by the group of recesses 26, 28 and 30, both the areas being located symmetrical relative to the cam chain chamber 90' as seen in FIG. 1. Incidentally, the cover 230 has the inverted U-shaped cross-sectional configuration in order to assure increased mechanical strength. Further, the cover 230 is formed with fitting bolt insert holes 232 and pipe fitting holes 234 through which a pipe constituting oil feeding passage to be described later is inserted. Thus, when the thus designed covers 230 are assembled on the inside of the cylinder head 10 as illustrated in FIG. 1, all the recesses 20, 22, 24, 26, 28 and 30 are covered with them, as shown in FIG. 1 which is an enlarged partial plan view of the cylinder head 10. Once the recesses 20, 22, 24, 26, 28 and 30 are covered with the covers 230 in that way, it is assured that oil held in them is inhibited from being scattered inwardly of the cylinder head 10. In FIG. 5 reference numerals 240 designate a fitting bolt respectively, by means of which the covers 230 are fastened to the cylinder head 10. Further, in order to inhibit an excessive amount of oil from being deposited on exhaust valves, valve springs or the likes, plate-shaped seats 250 are fastened to the cylinder head 10, as shown in FIG. 6 which is an enlarged plan view of the valve spring seat and FIG. 7 which is a side view of the same. As is apparent from FIG. 6, each of the valve spring seats 250 is formed with a plurality of valve guide insert holes 252 and it has the L-shaped cross-sectional configuration so as to assure increased mechanical strength. FIG. 8 is a partial plan view particularly illustrating how the valve spring seats 250 are fastened to the inside of the cylinder head 10 and same parts as those in FIGS. 1 and 5 are identified by same reference numerals. It should be noted that the valve spring seat 250 is immovably held on the valve seat by means of valve springs (not shown) in such a manner that a plurality of valve guides are simultaneously fitted through a single sheet of plate, resulting in any occurrence of undesirable turning movement of the valve spring seat as is seen with the conventional circular disc-shaped valve seat being prevented.

Next, description will be made in more details as to the oil feeding passages through which oil is fed to the recesses 20, 22, 24, 26, 28 and 30 on the cylinder head 10.

Figure 9:
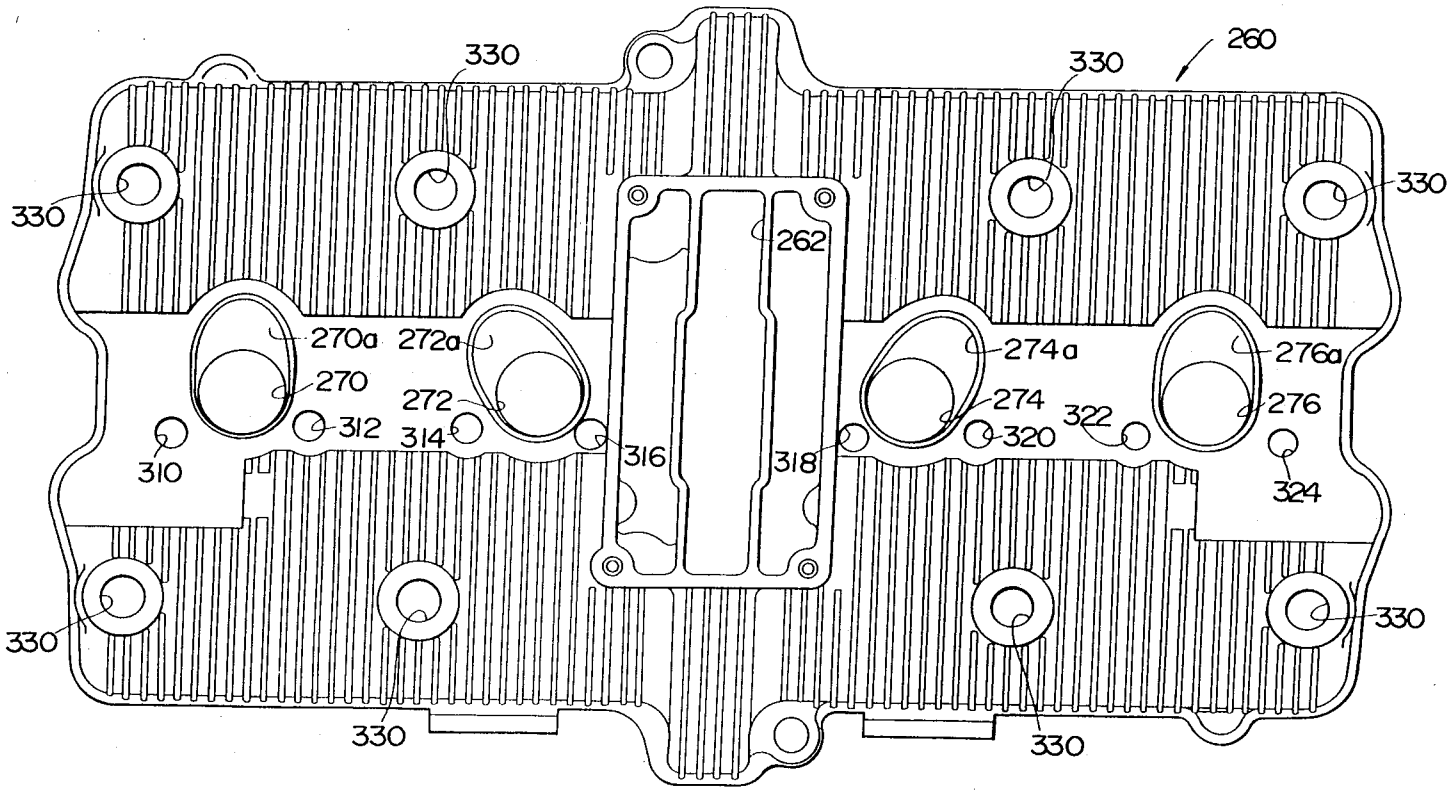
FIG. 9 is a plan view of the cylinder head cover, as seen from the above.
Figure 10:
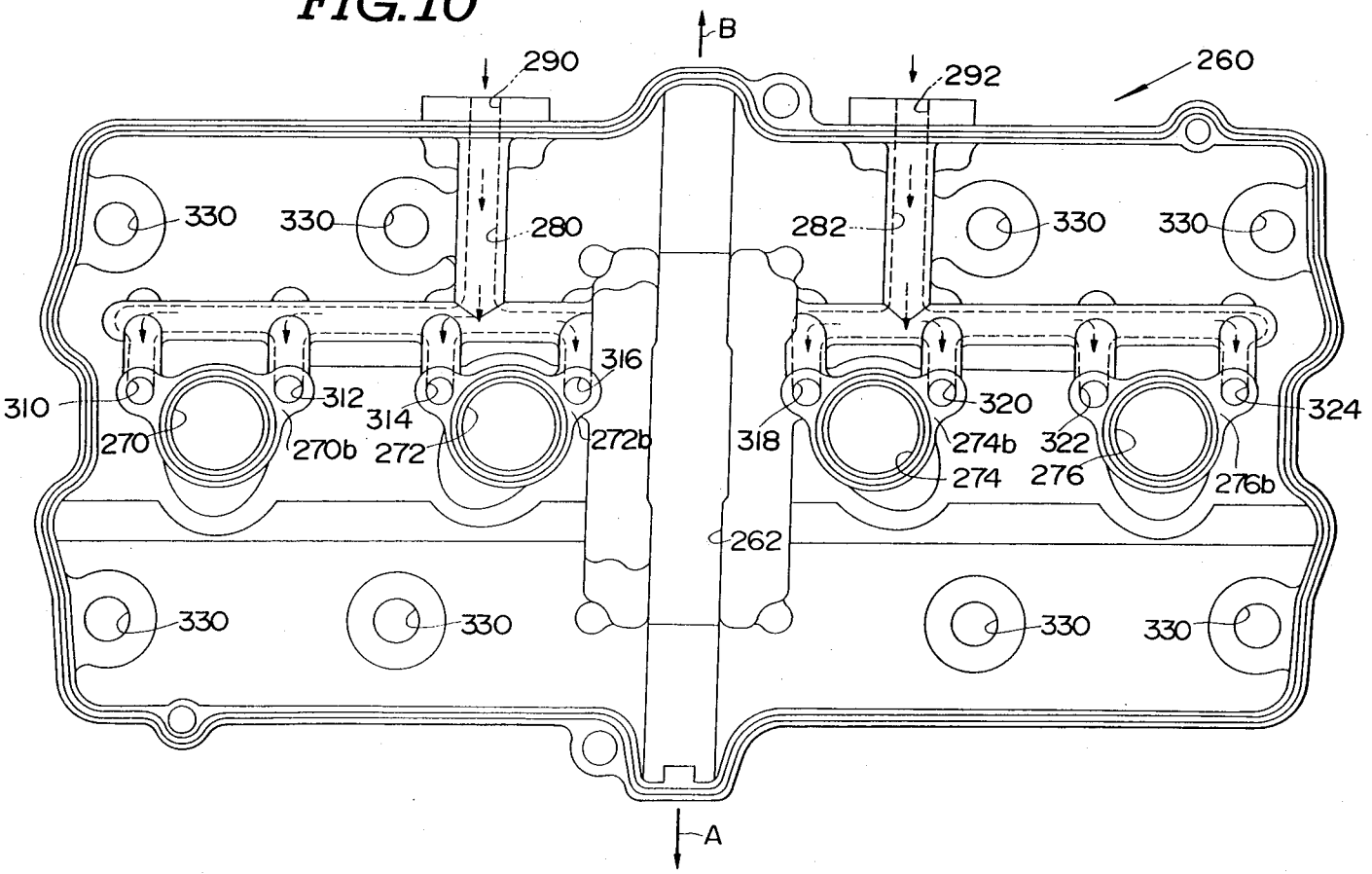
FIG. 10 is a plan view of the cylinder head cover in FIG. 9, as seen from the below.

FIGS. 9 and 10 are a plan view of a cylinder head cover 260 as seen from the above and below respectively, with which the cylinder head 10 as shown in FIG. 1 is covered.

Figure 11:
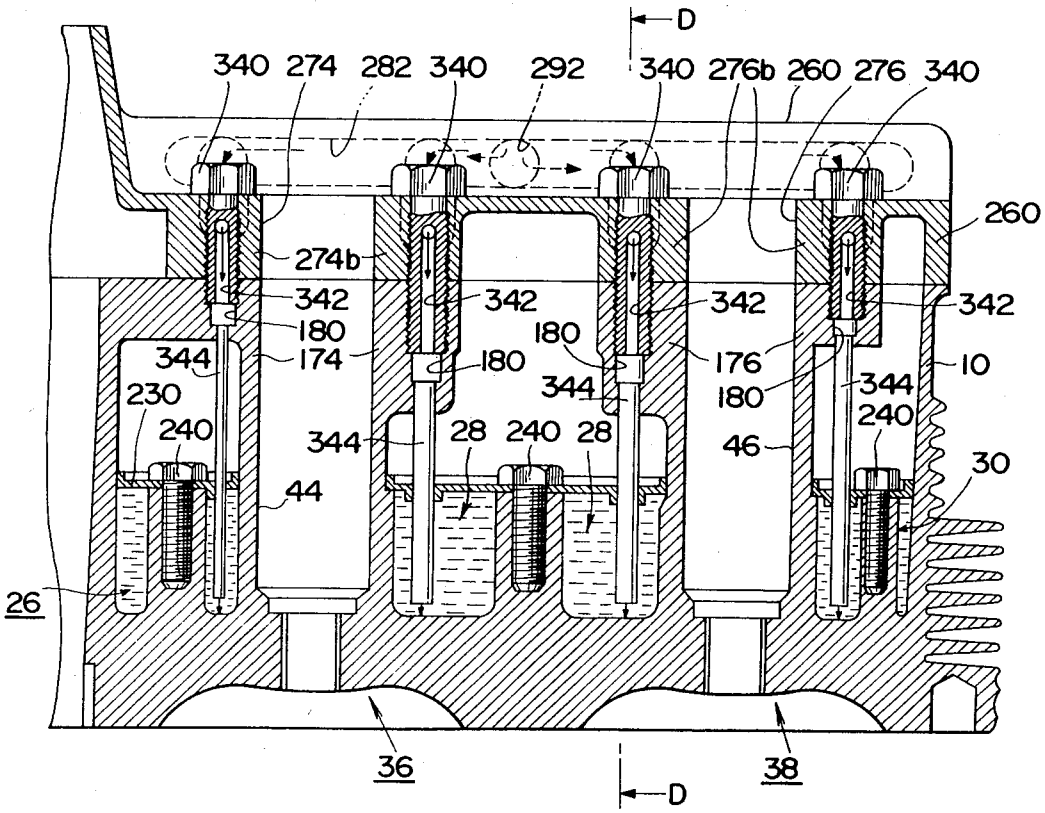
FIG. 11 is a fragmental vertical sectional view of the right half of the cylinder head with the cylinder head cover firmly mounted thereon.
Figure 12:
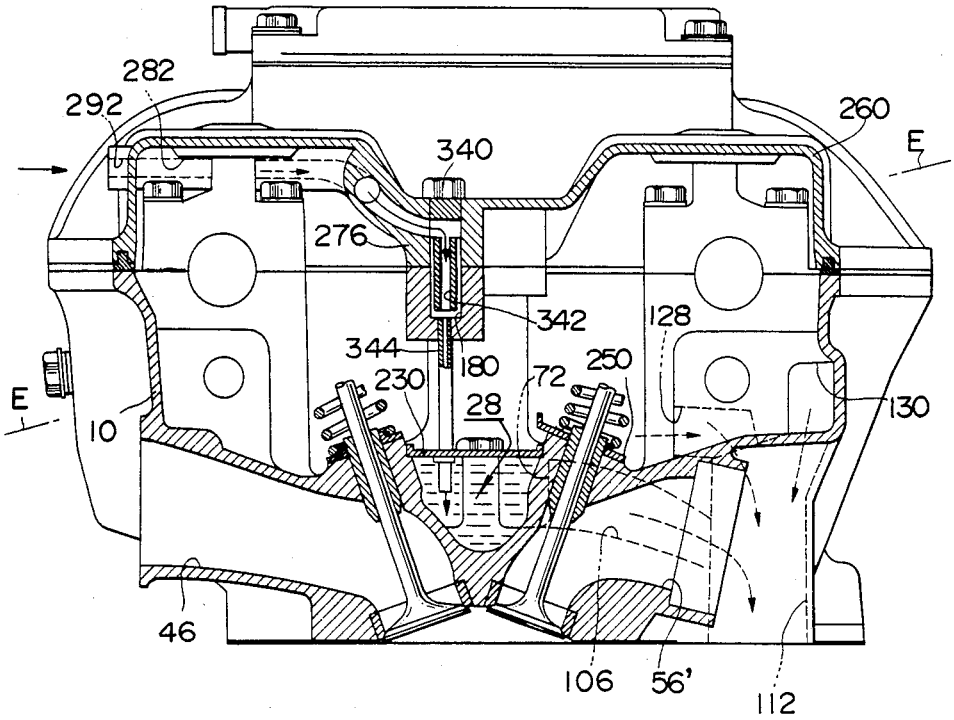
FIG. 12 is a vertical sectional view of the combination of cylinder head and cylinder head cover, taken in line D—D in FIG. 11.
Figure 13:
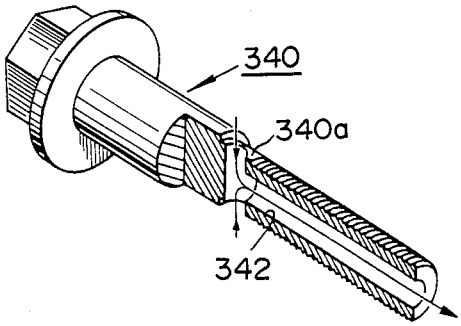
FIG. 13 is a partially sectioned perspective view of a cylinder head fastening bolt, shown in an enlarged scale.

The cylinder head cover 260 is designed in the plate-shaped configuration so as to fully cover the whole surface of the cylinder head 10 and it is formed with an opening 262 at the central part thereof through which blow-by gas is taken out. Further, it is formed with a plurality of insert holes 270, 272, 274 and 276 through which ignition plugs and ignition plug fitting and removing tools are inserted, the insert holes 270, 272, 274 and 276 being arranged at the central part thereof as seen in the longitudinal direction on the drawings. Incidentally, inclined guide grooves 270*a*, 272*a*, 274*a* and 276*a* are formed on the inner wall of the insert holes 270, 272, 274 and 276. As shown in FIG. 10, oil feeding passages 280 and 282 through which oil pumped up from an oil supply source (not shown) is introduced into the central part of the cylinder head cover 260 are formed on the bottom surface of the head cover 260. The one ends of the oil feeding passages 280 and 282 are communicated with feeding ports 290 and 292 on the inlet port side of the cylinder head cover 260, whereas the other ends of the same are branched to reach flange portions 270*b*, 272*b*, 274*b* and 276*b* on the insert holes 270, 272, 274 and 276. The flange portions 270*b*, 272*b*, 274*b* and 276*b* have insert holes 310, 312, 314, 316, 318, 320, 322 and 324 formed thereon through which fastening bolts (which will be described later) for immovably fastening the cylinder head cover 260 to the cylinder head (see FIG. 1) are inserted and the other ends of the branched parts of the oil feeding passages 280 and 282 are communicated with the insert holes 310, 312, 314, 316, 318, 320, 322 and 324. Owing to the arrangement made in that way, as oil is fed through the feeding ports 290 and 292 as represented by arrow marks on the drawing, it flows in the oil feeding passages 280 and 282 to reach the insert holes 310, 312, 314, 316, 318, 320, 322 and 324. It should be noted that the insert holes 310, 312, 314, 316, 318, 320, 322 and 324 are located opposite to the holes 180 on the flange portions 170, 172, 174 and 176 of the bosses 40, 42, 44 and 46. Incidentally, in FIGS. 9 and 10 reference numerals 330 designate an insert hole respectively, through which a fastening bolt is inserted to immovably fasten the cylinder head cover 260 to the cylinder head 10 (see FIG. 1). After oil reaches the insert holes 310, 312, 314, 316, 318, 320, 322 and 324 on the cylinder head cover 260, it flows through oil passages 342 formed in the fastening bolts 340 and pipes 344 fitted into the holes 180 on the flange portions 170, 172, 174 and 176 as shown in FIG. 11 which is an enlarged fragmental sectional view of the cylinder head cover 260 fastened to the cylinder head 10 and FIG. 12 which is a cross-sectional view of the cylinder head 10 and the cylinder head cover 260 taken in line D—D in FIG. 11. Thereafter, it is supplied into each of the recesses 20, 22, 24, 26, 28 and 30 on the cylinder head 10. As mentioned above, in the embodiment as illustrated in FIG. 12 oil is introduced into the recesses 20, 22, 24, 26, 28 and 30 via the holes 180 on the flange portions 170, 172, 174 and 176 and the pipes 344 but the present invention should not be limited only to this. Alternatively, arrangement may be made such that the flange portions 170, 172, 174 and 176 are extended until they reach the recesses 20, 22, 24, 26, 28 and 30 and an oil passage is drilled through each of the flange portions 170, 172, 174 and 176 without any use of pipes such as the pipes 344. In the case of a fastening bolt 340 as illustrated in FIG. 13 by way of enlarged sectional perspective view it is formed with a T-shaped oil passage 342 so that oil is introduced toward the lowermost end through the oil passage 342 after entrance from the peripheral surface 340*a* of the bolt 340 as represented by arrow marks. Incidentally, parts in FIGS. 11 and 12 as those in FIGS. 1, 3, 5, 8 and 11 are identified by same reference numerals. After oil is supplied into each of the recesses 20, 22, 24, 26, 28 and 30 on the cylinder head 10, it is discharged into the insert holes 90, 92, 94 and 96 or the main discharging passages 110 and 112 via the discharging holes 60, 62, 64, 66, 68, 70, 72 and 74 (see FIG. 1) on the peripheral walls 20*a*, 22*a*, 24*a*, 26*a*, 28*a* and 30*a* of the recesses 20, 22, 24, 26, 28 and 30.

It should be noted that an engine mounted on motorcycle is usually mounted thereon in the forwardly inclined posture as seen in the direction of running due to a requirement for reducing the height of the body as far as possible. For the reason the cylinder head 10 is held in such an inclined state that the exhaust port side is lowered as represented by a horizontal line E—E in FIG. 12 whereby oil discharged into the cylinder block after slidable components such as cam shafts or the like are lubricated properly is caused to flow into the discharging holes 120, 122, 124, 126, 128 and 130 as shown in FIG. 1 in the same manner as oil temporarily accumulated in the recesses and thereafter it is discharged into the main discharging passages 110 and 112 via the discharging holes.

Figure 14:
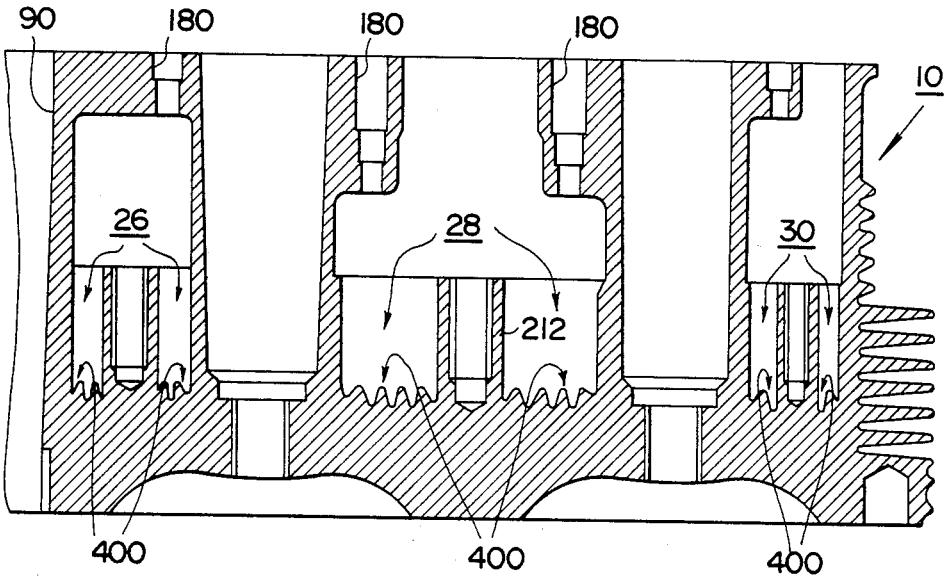
FIG. 14 is a fragmental vertical sectional view of the right half of the cylinder head, particularly illustrating how each of the recesses has a rugged bottom surface.
Figure 15:
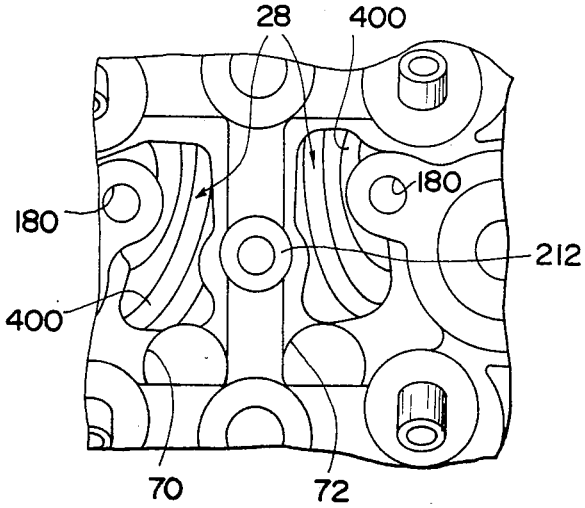
FIG. 15 is a fragmental plan view of the cylinder head in FIG. 14, particularly illustrating how a number of ridge lines on the recesses extend.

In the above-described embodiment each of the recesses 20, 22, 24, 26, 28 and 30 has a flat bottom surface 400 which extends substantially in parallel with the upper surface of the associated combustion chamber, as shown in FIG. 3. However, the present invention should not be limited only to this. Alternatively, each of the recesses 20, 22, 24, 26, 28 and 30 may have a rugged bottom surface in order to increase contact area over which oil temporarily accumulated in the recess comes in surface contact with the associated bottom surface 400 and thereby assure increased cooling effect in the presence of oil, as shown in FIG. 14 which is a fragmental enlarged vertical sectional view. Also in this embodiment same parts as those in FIG. 3 are identified by same reference numerals. In addition to this a number of ridge lines on the rugged bottom surface may have specific directional configuration, ask shown in FIG. 16 which is a fragmental plan view of FIG. 15. This embodiment is intended to allow oil to smoothly flow toward the discharging holes.

As will be obvious for any expert in the art, various changes or modifications may be made for the invention in any acceptable manner without departure from the spirit and scope of the invention. Accordingly, it should be considered that the above-described embodiments are merely illustrative and therefore they should not be interpreted limitatively. After all, the scope of the invention is as defined by the claim clause without any restriction or limitation being effected by the description of the specification. Finally, it should be understood that all changes or modifications falling under scope of the claim clause should be construed within the scope of the invention.

What is claimed is:

1. An apparatus for cooling a cylinder head of an engine comprising a recess formed around a plug seat in a cylinder head, pump means for pumping lubricating oil up from an oil pan and feeding the oil under pressure; nozzle means having a jetting outlet closely adjacent a bottom of said recess for spouting the oil fed under pressure by said pump means without passing through a valve actuating mechanism; and a cover adapted to cover an upper open surface of said recess.

2. The apparatus as defined in claim 1 wherein said cover is a plate having a generally V-shaped cross-sectional configuration.

3. An apparatus for cooling a cylinder head of an engine comprising:

a cylinder head;

a recess for accumulating oil therein formed in said cylinder head at a position located above associated combustion chambers;

a cover adapted to cover said recess;

valve seats formed in said cylinder head; and a plate-shaped valve spring retainer disposed between said valve seats and valve springs mounted on said valve seats for holding said cover, and said valve spring retainer being formed with a plurality of holes at positions corresponding to associated valve guides.

4. The apparatus as defined in claim 3 wherein said valve spring retainer has an L-shaped cross-sectional configuration.

5. An apparatus for cooling a cylinder head of an engine comprising a plurality of recesses for accumulating oil therein, said recesses being formed in said cylinder head at a position located above combustion chambers, a cover adapted to cover said recesses, said cylinder head being formed with a plurality of valve seats and a plate-shaped valve spring seat being disposed between the valve seats and valve springs mounted on the latter, and said valve spring seat being formed with a plurality of holes of which the pitch is determined equal to the pitch as measured between adjacent valve guides.

6. The apparatus as defined in claim 5 wherein the valve spring seat is of a generally L-shaped cross-sectional configuration.

* * * * *